US005118430A

United States Patent [19]

Rebouillat et al.

[11] Patent Number: 5,118,430

[45] Date of Patent: Jun. 2, 1992

[54] SURFACE TREATMENT AGENT FOR POLYAMIDE FIBERS

[76] Inventors: Serge Rebouillat, Farges, Farges, France, F 01550; Eugen Scheidt, Johannes-Hesse-Str. 33; Hans-Gunter Seltmann, 100 Oranienburger Strasse, both of Dusseldorf 13, Fed. Rep. of Germany, D 4000

[21] Appl. No.: 347,906

[22] Filed: May 5, 1989

[30] Foreign Application Priority Data

May 6, 1988 [DE] Fed. Rep. of Germany ..... 3815543

[51] Int. Cl.[5] ..... D06M 15/00

[52] U.S. Cl. ..... 252/86; 8/115.56; 8/115.6; 8/DIG. 21; 525/134; 525/139; 525/144; 428/395

[58] Field of Search ..... 252/8.6; 524/510; 525/134, 139, 144; 8/115.6, 115.7, 115.56; 427/390

[56] References Cited

U.S. PATENT DOCUMENTS

| | | | |
|---|---|---|---|
| 2,267,265 | 12/1941 | Bock et al. | 91/70 |
| 3,597,379 | 8/1971 | Van Valkenburg | 524/510 |
| 4,336,171 | 6/1980 | Kohlstadt et al. | 524/510 |
| 4,483,962 | 7/1983 | Sapowski | 524/532 |
| 4,557,967 | 11/1983 | Willemsen et al. | 428/224 |
| 4,720,398 | 3/1985 | van Aalten et al. | 427/208.2 |

FOREIGN PATENT DOCUMENTS

| | | |
|---|---|---|
| 51477 | 6/1977 | Australia . |
| 161373 | 11/1985 | European Pat. Off. . |

*Primary Examiner*—Prince Willis, Jr.
*Assistant Examiner*—John F. McNally

[57] ABSTRACT

The present invention involves an aqueous surface treatment agent for polymer fibers on the basis of a resin preparation, characterized in that it contains 1–30 percent by weight of a polar phenoplast of the resol type 2–40 percent by weight of a copolymer, crosslinkable with resols, of a radical polymerizable, aromatic hydroxymethyl and/or methyl halogen compound and water to make 100 percent by weight, wherein, if desired, up to 5 percent by weight further adhesion promoters can be present.

This invention also involves the use of the surface treatment agent for the modification of organic or inorganic polymer fibers, preferably polyamide or polyimide fibers, particularly aromatic polyimide fibers, and a process for the modification of polymer fibers.

9 Claims, No Drawings

SURFACE TREATMENT AGENT FOR POLYAMIDE FIBERS

The invention involves a surface treatment agent for polymer fibers, polymer fibers treated with it and a process for coating polymer fibers with such an agent. The aqueous surface treatment agent of the invention results in improved compatibility of the fibers with a matrix in which the fibers are embedded. Fibers for the purpose of the invention are understood to be continuous filaments as well as staple fibers, crimped staple fibers, fiber tows, yarns and the like as well as flat textile skeins, be they woven, knitted or by other means bonded as non-wovens.

Reinforcement of synthetic resins with organic or inorganic fibers is known to produce better material properties. The tensile strength of such composite materials or other mechanical properties is increased as a function of the quantity of incorporated fiber.

Nevertheless, it has been shown that the full performance capability of the fibers cannot be used in many instances, because fracture occurs in connection with the breaking process at the interface of the fiber with the matrix and the fibers can, so to speak, be pulled out of the matrix. Such phenomena are seen particularly with very high tensile strength fibers, for example aramid fibers.

To prevent these, fibers are coated in practice with surface treatment agents, for example, epoxide resin preparations or with other resins. Examples are described in U.S. Pat. Nos. 4,557,967 and 4,652,488.

However, for many industrial uses, the resulting improvements in fiber adhesion capability in the matrix are still not adequate. Furthermore, the treatment of the fibers with epoxides results to some extent in embrittlement so that the treated fibers can break or splay in subsequent textile processing steps, such as knitting or weaving.

From the German 34 25 381 there has been known a terpolymer latex which is prepared by emulsion polymerization of 2,3-dichloro-1,3-butadiene and a mixture of at least two different unsaturated monomers, e.g. 4-vinylbenzyl chloride, the unsaturated monomers being at least individually polymerizable with 2,3-dichloro-1,3-butadiene. Therein, also adhesive systems are described which are suitable for bonding natural and synthetic elastomers to rigid and non-rigid substrates. The latices, if intended to be used for bonding, contain an aromatic nitroso compound. Indications of that these latices can be employed as raw materials for a surface treatment agent for polymer fibers are not derivable from the documents of German 34 25 381.

German 34 00 851 describes a bonding agent to vulcanize rubber on a substrate stable to vulcanization, the binder containing, in addition to other components, a copolymer from a halogenated, conjugated diene, an alkylated monoalkenyl-aromatic alkyl halide and if desired, an unsaturated carboxylic acid. The application also describes that such a binder can be used for the adhesion of aramid fibers in rubber. It is further disclosed that the binder can be used on pretreated fibers, for example, on fibers that have been pretreated with a phenol resin. The binders of this application are not surface treating agents for polymer fibers. They yield brittle films that can spall in the case of kinked fibers. This unsatisfactory flexibility is also observed if the binder is used on treated fibers, such as those fibers pretreated with a phenol resin as primer.

Even if fibers, for example, aramid fibers, are pretreated with resol type phenoplasts in aqueous solution as used in the surface treatment agents of the invention described in the following and then coated with the binders of German 34 00 851, spalling (from brittleness of the films) and other unsatisfactory tensile characteristics in the composites of the thus-treated fibers with the matrix are observed.

Furthermore, the binders of German 34 00 851 contain aromatic dinitroso compounds as crosslinkers. As many patents and patent applications show, experts consider these compounds indispensable for bonding vulcanizable rubber mixtures on substrates stable to vulcanization. However, there is concern with aramid fibers that aromatic dinitroso compounds or their products from the ageing process can degrade the mechanical stability of the fiber.

Therefore, the problem involved in the invention is to prepare a surface treatment agent for polymer fibers, an agent which, in textile processing of the fibers (continuous filament yarns, staple fibers, yarn, etc.), neither spalls from the fiber nor embrittles the fiber and which, on incorporation of the fiber into a polymer matrix, promotes high bonding strength for the fiber to the matrix.

In industrial practice it is further desired to improve the flexibility properties of the fibers and the lubricating effect of fiber coatings and to reduce fiber-to-fiber friction. In some applications it is desirable to reduce the water absorption by the fiber. Thus, it is one object of the present invention to provide surface treatment agents for fibers which agents also improve the processing properties of fibers, and more particularly of aramide fibers, by causing an improvement in processing during knitting and weaving, an increase in fatigue strength and a reduction in water absorption to be provided.

A further problem in the invention is to prepare a fiber-forming polyamide material, particularly a fiber-forming aromatic polyamide material, that shows improved bonding capability on other substrates, for example, rubber, that shows satisfactory resilience and processability as well as outstanding resistance to material fatigue. An additional problem in the invention is to prepare a process for the production of such fiber-forming polyamides, in which process the coating with the surface treatment agent can take place before or after stretching.

Accordingly, the subject of the invention is an aqueous surface treatment agent for polymer fibers on the basis of a resin preparation, characterized in that it contains:

1–30 percent by weight of a polar phenoplast of the resol type

2–40 percent by weight of a copolymer, crosslinkable with the resol, of a radical-polymerizable, aromatic hydroxymethyl and/or methyl halogen compound and water to make 100 percent by weight, wherein, if desired, up to 5 percent by weight in additional adhesion promoters can be present.

Additional subjects of the invention are fibers, which are coated with such surface treatment agents, a treatment process for fibers with this surface treatment agent and the use of the surface treatment agent for coating polymer fibers.

The surface treatment agents of the invention contain a polar phenoplast of the resol type. It involves a condensation product from aldehydes, particularly formaldehyde and phenols. Suitable phenoplasts can be prepared from, for example, phenol, cresols, resorcinol, bisphenol A or xylenols. Basic condensed products are involved with a formulation ratio of one to three moles aldehyde, particularly formaldehyde, calculated on the phenol component. Such phenoplasts of the resol type are known.

Preferred products of the invention are of such low molecular weight that they are soluble or at least dispersible in water.

Preferred phenoplasts are phenol formaldehyde resins. Generally, the short chain products are especially important. Thus, a particularly preferred product in 65 percent by weight aqueous solution shows a viscosity of 0.3 to 1.4 Pas, especially about 0.7 Pas.

Good results were achieved with resols that are water soluble and show a softening point between 65° and 70° C.

Resol type phenoplasts are present in quantities of 1 to 30 percent by weight in the aqueous surface treatment agents. A phenoplast concentration between 2 and 10 percent by weight, particularly between 3 and 8 percent by weight, is preferred.

As additional components, the surface treatment agents of the invention contain 2 to 40 percent by weight of a copolymer, crosslinkable with resols, of a radical polymerizable, aromatic hydroxymethyl and/or methyl halogen compound; these components are present preferably in dispersed form.

These components generally involve a copolymer. The following monomers are particularly suitable as radical polymerizable halogen methyl compounds: 2-, 3- or 4-vinylbenzyl chloride (VBC), whose individual isomers or preferably their mixtures can be used, 2-, 3- or 4-(1-chloroethyl)-vinyl benzene, 2-, 3- or 4-1-(chlorobutyl)-vinyl benzene or isomers of chloromethylvinyl naphthalene.

In addition to or instead of these radical polymerizable, aromatic halogen methyl compounds, the corresponding hydroxymethyl compounds can also be used. In many cases, these hydroxymethyl compounds are obtained from halogen methyl compounds by hydrolysis, for example, by heating the monomers or polymers during polymerization or afterwards. The copolymers then contain small quantities of HCl that can catalyze the reaction of the resols with the copolymer or with the fiber to be coated.

Particularly important monomers within the scope of the invention are the isomeric vinylbenzyl chlorides (VBC) and the isomeric vinylbenzyl alcohols (VBA). Thus, for example, a mixture of 60 percent by weight of meta compound (3 VBC) and 40 percent by weight of para compound (4 VBC) and their hydrolysis products (3 VBA and 4 VBA) can be used successfully.

In the copolymers used in the invention, the quantity of radical polymerizable hydroxymethyl and/or halogen methyl compound, calculated on the copolymer, is generally between 2 and 10, particularly between 3 and 8 percent by weight, each calculated on the copolymer.

The expert can select the degree of conversion of halogen compound into alcohol compound (VBC into VBA) within wide limits. Thus, 10% of the halogen methyl groups, but also 30, 50, 70 and even more than 90% can be saponified, that is, be converted into hydroxymethyl groups.

Furthermore, the copolymers incorporated in the surface treatment agents of the invention are composed of still other monomers. Olefins or diolefins, which also can contain halogen, are particularly suitable. Esters or amides of acrylic or methacrylic acid can also be used. Further, ethylenically unsaturated carboxylic or dicarboxylic acids and/or their salts have been shown to be advantageously copolymerized.

General knowledge of polymer chemistry applies here, that is, the expert will have to consider copolymerization parameters in the choice of suitable monomers and coordinate the choice and the reaction conditions accordingly.

The following comonomers are listed as examples: acrylic acid, methacrylic acid, maleic acid, maleic acid anhydride, itaconic acid, citraconic acid, crotonic acid, styrene, methyl styrene, butadiene, isoprene, halogenated butadiene, such as, for example, dichlorobutadiene, particularly 2,3-dichloro-1,3-butadiene, halogenated isoprenes, vinyl chloride, vinylidene chloride, ethene, propene, vinyl esters, vinyl ethers, esters of acrylic or methacrylic acid with primary alcohols of $C_1$–$C_{18}$ chain length, functional acrylates or methacrylates, such as, for example, hydroxyethyl acrylate or hydroxymethacrylate, glycidyl acrylate or glycidyl methacrylate, acrylonitrile, acrylamide and substituted acrylamides and/or methacrylamides.

From the wide choice of possible and suitable copolymers, copolymers of the cited radical polymerizable, aromatic hydroxymethyl and/or methyl halogen compounds with halogenated diolefins are particularly suitable; unsaturated carboxylic acids can also be copolymerized. Especially suitable for this are copolymers of VBA and/or VBC with halogenated diolefins and if desired, unsaturated carboxylic acids or dicarboxylic acids.

A preferred copolymer consists of VBA and/or VBC, dichlorobutadiene and acrylic acid. It has been shown to be particularly advantageous to make copolymers from 80 to 95 percent by weight dichlorobutadiene, 2 to 10 percent by weight acrylic acid and 2 to 10 percent by weight VBA and/or VBC, calculated on the copolymer. A particularly suitable copolymer comprising 3 monomer constituents is described in German 34 25 381.

The emulsion copolymers employed according to the invention have a pH value within the range of from 2 to 3 as a latex, more particularly if unsaturated carboxylic acids are simultaneously present. Since such acidic compositions produce undesirable effects upon the treatment of the fiber, it is advisable to adjust the pH to a value within the range of between about 5 and 11, and preferably 6 and 10, by means of acid catchers or buffers. As the acid catchers or buffers there may be used zinc oxide, dibasic lead phosphate, sodium acetate and the like. Such acid catchers are employed in amounts sufficient to obtain the desired pH value.

Furthermore, the surface treatment agents of the invention can contain additional adhesion promoters. Ethylenically unsaturated carboxylic acids, in which the carbonyl group is conjugated with the double bond and/or their derivatives have been shown to be good adhesion promoters. Corresponding compounds with 3 to 10 carbon atoms are suitable, particularly acrylic acid, methacrylic acid, maleic acid, fumaric acid, itaconic acid, citraconic acid and their derivatives. Among the derivatives that can be used are the anhydrides, amides, also substituted with a $C_1$–$C_5$ alkyl group, esters and nitriles. Preferred adhesion agents are, for example, acrylic acid and the half ester of maleic acid, preferably with $C_1$–$C_6$ alcohols.

Another class of adhesion agents are melamine resins. These are the condensation products of melamine with aldehydes, particularly formaldehyde. Low molecular weight, water soluble condensation products and their etherification products with lower alcohols are preferred, for example, hexamethylol melamine, hexaalkyl ether of hexamethylol melamine, particularly hexamethyl ether. The adhesion promoters are used in quantities up to 5 percent by weight, calculated on the surface treatment agent. In this connection, it has been shown that, in the case of unsaturated carboxylic acids and their derivatives, comparatively small quantities, specifically 0.001 to 1 percent by weight, produce good results. Quantities of this magnitude are often present as residual monomer content in the polymer latexes described previously; the expert can control the content of residual monomers by choice of polymerization conditions (for example, through the quantity of initiator and method of addition).

The melamine resins are added preferably in quantities up to 3 percent by weight, especially in quantities of 0.5 to 1.5 percent by weight.

The copolymers used in the invention are present preferably as a latex. To prepare the surface treatment agent of the invention, it is best to conduct first an emulsion polymerization to make the copolymer. Then the resol type phenoplast can be added to the polymer latex thus prepared; addition of the resol type phenoplast as aqueous solution or dispersion is preferred; this applies also to the adhesion promoter.

The surface treatment agents of the invention contain residues of additives mostly from the preparation of the polymer dispersions. These are principally emulsifiers and/or dispersing agents and residues from initiators, perhaps inorganic salts.

Essential importance for the latices which the preparation of the surface treatment agents is based on is to be attached to the surface-active agents employed in the emulsion polymerization of the copolymers. Here, anionic surface-active agents or mixtures thereof with non-ionic surface active agents are preferred. The surface-active agents are employed within a range of between 0.01 and 15% by weight, and preferably from 1 to 10% by weight, based on a copolymer latex having a content of 4% of active substance. The use of a mixed anionic/non-ionic surface-active system having a ratio of from 1.3 to 2.1:1, and preferably of from 1.3 to 2.0:1, of anionic to non-ionic agents is preferred. Representative anionic agents are carboxylates such as fatty acid soaps from lauric, stearic and oleic acids and the acyl derivatives of sarcosine such as methyl glycine; sulfates such as sodium lauryl sulfate; sulfated natural oils and esters, such as Turkey-red oil and alkylaryl polyethersulfates; alkylaryl polyethersulfonates; isopropyl naphthalenesulfonates and sulfosuccinates such as sulfosuccinanates; phosphate esters such as partial esters of complex phosphates with short-chain fatty alcohols; and orthophosphate esters of polyethoxylated fatty alcohols. Representative non-ionic agents include ethoxylated (ethylene oxide derivatives), mono- and polyhydric alcohols, ethylene oxide/propylene block copolymers; esters such as glycerol monostearate; dehydration products of sorbitol such as sorbitan monostearate and polyoxyethylenesorbitan monolaurates. At present, a 1.8:1 mixture of sodium dodecyldiphenylether disulfonate as anionic surface-active agent and nonylphenylpolyethylene glycol as non-ionic surface-active agent is preferred. Anionic and anionic/non-ionic surface-active systems which have to be used according to the invention have been described in detail in "Emulsions: Theory and Practice" by Paul Becher, Chapter 6, Reinhold Publishing Corporation New York, 1965, as well as in McCutcheons's "Detergents and Emulsifiers, 1972 Annual".

Furthermore, the surface treatment materials of the invention can also contain other additives, for example, stabilizers. Among the stabilizers, chlorine acceptors are preferred. These are compounds that can bond the eliminated HCl, for example, triethanolamine or epoxide compounds. Further additives are dyes.

Bonding materials can be used as additional additives. Suitable bonding materials are zircon aluminates that are derived from, for example, zirconium oxychloride ($ZrOCl_2.8H_2O$) and from aluminum chlorohydrate [$Al_2(OH)_5Cl$] and are used selectively reacted with carboxylic acids. More bonding materials are, for example, aminosilanes of the general formula $Y(CH_2)_nSiX_3$, in which n=0 to 3, X is a hydrolyzable group, for example, an alkoxy group or a halogen atom and Y is an organofunctional group. Examples are 4-aminopropyl triethoxysilane and other compounds, usually available commercially as silane primers. Additional suitable bonding materials are titanates of the general formula $YOTi(OX)_3$, in which Y is an isopropyl group and X is a long organic radical, for example, a stearate group.

Examples of further additives are UV absorbers, such as UV absorbers based on benzotriazole.

Further additives are also pigments, for example, pigments that are stable at temperatures up to 200° C.

If desired, emulsifiers or plasticizers can also be present in the surface treatment agents of the invention. However, the expert will use these components carefully in order to prevent a decrease in the bonding strength of the treated fibers to a matrix.

Coated polymer fibers of various kinds can be prepared in accordance with the invention. Thus, in particular, coated fibers of organic polymers and even from polymerizates, such as from polycondensation, can be prepared. Especially important coated fibers are fibers from polyamides, polyesters, polyimides, polyethers and/or polyurethanes, specifically based on aromatic and/or aliphatic units. Coated fibers from aromatic polyamides are especially important.

Within the scope of the invention, special significance is attributed to coated aromatic polyamide fibers. Fibers (continuous filaments, short staple fibers, tow, yarns or flat textile skeins) from aromatic polyamides with fiber type structure are generally considered among aromatic polyamide fibers. Aromatic polyamides are understood to be such polymers that are partially, preponderantly or exclusively composed of aromatic rings, which are connected through carbonamide bridges or optionally, in addition, also through other bridging structures. The structure of such aromatic polyamides can be elucidated in part by the following general formula: $(—CO—NH A_1—NH—CO—A_2)_n$, in which $A_1$ and $A_2$ signify aromatic and/or heterocyclic rings, that can also be substituted. An important class of surface-treated fibers of the invention is derived from fully aromatic copolyamides.

Examples of such aromatic polyamides are poly-m-phenylene isophthalamide with the trademark Nomex® (U.S. Pat. No. 3,287,324); poly-p-phenylene terephthalamide with the trademark Kevlar® (DE 22 19 703).

Further suitable polyamides are those structures in which at least one of the phenyl radicals bears one or more substituents, for example, lower alkyl groups, alkoxy groups or halogen atoms. Additional aromatic compounds contain, to some extent at least, repeating units that are derived from 3- or 4-aminobenzoic acid, respectively.

Additionally suited for finishing with the surface treatment agent of the invention are such completely aromatic polyamide fibers that have been stretched in a nitrogen atmosphere at a temperature above 150° C. according to German 22 19 646.

Additional suitable aromatic polyamides contain diaminodiphenylene groups in which two phenyl radicals each bearing an amino or carboxylic acid group are connected together through a bridging structure, for example, a heteroatom (O, S, $SO_2$, NR, $N_2$ or a $CR_2$ group, with R=H or alkyl groups) or a CO group. Finally, also suitable are aromatic polyamides in which the aromatic rings are partially replaced by heterocycles or the heterocycles participate as subsituents or chain members, as well as fibers from U.S. Pat. No. 4,075,172.

The surface treatment agents of the invention can be applied onto the fibers by simple means. Thus, it can be useful to pass the fibers through a bath containing the surface treatment agent and then to dry them. Afterwards, it is frequently useful to harden the surface treatment agent on the fiber by heating. For the purpose, the coated fibers are exposed temporarily to elevated temperature. For example, fibers with a high melting point can be annealed some seconds to several minutes at temperatures of 140° to 180° C., preferably around 160° C.

The coating of aramid fibers or other polyamide fibers with the surface treatment agents of the invention can take place in various ways, for example, by the fibers (continuous filaments, yarn, etc.) being immersed before drying, i.e. in a never-dried condition (on line) or after drying as dried fiber (off line) in a bath provided with the surface treatment agent. If desired, in a multistep process the fiber as well may be several times immersed in a surface treatment agent and in turn dried. Drying may be effected by convection (e.g. hot air), heat conduction (e.g. contact drying), irradiation (e.g. infra-red). The heat treatment of the fiber is usually carried out at temperatures between 80° C. and 220° C. for a period of from a few seconds to some minutes, depending on the drying degree requirements for further applications. In the course thereof, the machine speed may be selected from a few meters per minute until several hundred meters per minute, while, as a generally rule, also the amount of absorption of the surface active agent is controlled by means of said machine speed. Thus, for example, unstretched, wet polyamide and special aramid fibers can be passed through a bath containing the surface treatment agent. The surface treatment agent therein can have a solids content of 17 to 30 percent by weight. Then drying takes place by hot air, if desired at 170° C., for example.

The surface treatment agents of the invention can, however, be applied, in the case of polyamides and specifically aramids, also on yarns, on cord or on flat textile skeins after drying. For this purpose, the yarn is passed, for example, through a bath containing the surface treatment agent in a concentration of 8 to 30 percent by weight. Drying can then take place under tension and at a temperature of, for example, 120° C.

The surface treated fibers of the invention have many uses. For example, they show improved substrate adhesion in cold adhesion processes, but can also be embedded in synthetic resins or vulcanized in rubber, in which case the fibers show improved bonding strength to polar and non-polar types of rubber.

EXAMPLES

Example 1

Intermediate Products/Methods 1.1 Phenol Resin Solution

A 65 percent by weight aqueous solution of a water soluble phenol resin with a softening point of 70° C. was prepared.

1.2 Copolymer

An approximately 40 percent by weight latex of a polymer of 90 parts by weight 2,3-dichloro-1,3-butadiene, 6 parts by weight acrylic acid and 4 parts by weight vinylbenzyl chloride (mixture of 3 VBC and 4 VBC) was prepared by emulsion polymerization in the presence of an ionic and a nonionic emulsifier according to Example 1 of German 34 25 381.

1.3 Preparation of Surface Treatment Agent

Phenol resin solution and copolymer latex were mixed together in various proportions and a surface treatment agent was prepared therefrom with a solids content between 10 and 25 percent by weight. Polyester (polyethylene terephthalate) fabrics and polyamide (6/6) fabrics were immersed in the solutions and treated after drying at room temperature 2 minutes at 160° C.

To test the properties of the surface treated fibers, 2.5 cm wide fabric strips were cut and these were cemented together with a commercial polyurethane adhesive (Macroplast® UK 8205/5400, Henkel KGaA). The peel strengths of the composites were measured for evaluation.

Example 2

As described in Example 1, a surface treatment agent was prepared containing 3 percent by weight phenol resin and 12 percent by weight copolymer.

Example 3

A surface treatment agent was prepared containing 3 percent by weight phenol resin and 8 percent by weight copolymer.

The peel strengths obtained are summarized in the following table.

TABLE

| | Peel Strength on: | |
|---|---|---|
| | Polyester Fabrics | Polyamide Fabrics |
| Surface Treatment Agent of the Invention | | |
| Example 2 | 20 N/cm | 16 N/cm |
| Example 3 | 17 N/cm | 14 N/cm |
| Comparison Examples: Surface Treatment Agent | | |
| Without pretreatment | 10 N/cm | 9 N/cm |
| 12% copolymer only | 17 N/cm | 12 N/cm |
| 5% phenol resin only | 13 N/cm | 10 N/cm |
| Binder of EP 161373 | 12 N/cm | 10 N/cm |
| Equivalent to German 3.400.851 | | |
| Coating 4% phenol resin first, then 12% copolymer: | 13 N/cm | 10 N/cm |

Example 4

Results on Aramid Fibers 4.1 Coating Before Stretching

Continuous filament aramid fiber of the p-phenylenediamine terephthalamide type with a water content of about 70% by weight was passed through a bath containing the surface treatment agent of the invention (total solids content 17 percent by weight, comprising 12 percent by weight latex and 5 percent by weight phenol resin) and then dried at 170° C. The solids uptake of the fiber was about 2.7 percent by weight, calculated on the fiber. The dried fiber was stretched in the usual manner.

4.2 An aramid yarn of the same chemical structure was passed through the same bath of the surface treatment agent after drying (offline) and then dried at about 120° C. The yarn had an initial tension of 0.6 daN; it involved a zero twist 1670 dtex yarn. The yarn was passed through the bath at a speed of about 30 m/min. The solids uptake was about 3%.

4.3 The coated yarn before drying (online) and after drying (offline) was subjected to an adhesion and fatigue test (Cofad test). In addition, dynamic material fatigue was measured on a fiber-reinforced rubber block by the use of a disk fatigue tester that compresses and elongates the rubber blocks cylindrically (see U.S. Pat. No. 2,559,069). Material fatigue was determined either visually or mechanically, the reinforcing fibers being separated by dissolution of the rubber in toluene.

The adhesion characteristic was measured before and after fatiguing by pulling the yarns out of the rubber block.

For preparation of the test samples, aramid yarns (Kevlar® 1670 dtex, 80 t/m) treated after stretching were placed into various rubber compositions and vulcanized at 160 ° C. for 20 minutes. In addition, the rubber compositions containing the yarns were pressed between 2 plates of an electrically heated hydraulic press (18 t).

To determine the adhesive strength of the yarns, these were pulled out of the rubber blocks at a pulling speed of 125 mm/min.

For the fibers treated with the agent of the invention after stretching (offline) pulling forces of 200N (rubber composition ACM); 226N (rubber composition CR); 196N (rubber composition EPDM), compared with 93/145/100 for untreated fibers and 173/141/115 for conventionally (online) treated fibers.

5. Knitting Trials with Treated Yarns

Aramid yarns (Kevlar®) were knitted on an ELHA® circular knitting machine (Model RRU). The test lasted 4 hours. The machine speed was 670 $min^{-1}$ and the knitting speed, 15 m/min. In contrast to untreated fibers, no abrasion was observed. The structure of the knitted goods was uniform. Furthermore, no deposits formed on the knitting machine. This means that the surface treatment agent of the invention clearly improved the knittability of aramid yarns.

We claim:

1. Aqueous surface treatment agent for polyamide fibers on the basis of a resin preparation, characterized in that it consists essentially of 1–30 percent by weight of a phenoplast of the resole type selected from the group of water soluble and water dispersible phenoplasts prepared from aldehydes and phenols, cresols, bisphenol A or xylenols having a ratio of one to three moles aldehyde calculated on the phenol component 2–40 percent of a copolymer crosslinkable with resols characterized in that the copolymer is in dispersed form and contains a radical polymerizable monomer selected from the group of 3-vinylbenzyl alcohol, 4-vinylbenzyl alcohol, 3-vinylbenzyl chloride and 4-vinylbenzyl chloride and water to make up 100 percent by weight.

2. Surface treatment agent of claim 1 characterized in that the radical polymerizable monomer is 1 to 40 percent by weight calculated on the copolymer.

3. Surface treatment agent of claim 1 characterized in that the copolymer contains a member of the group of dichlorobutadiene and acrylic acid.

4. Surface treatment agent of claim 3 characterized in that the copolymer consists of 80 to 95 percent by weight dichlorobutadiene, 2 to 10 percent by weight acrylic acid and 2 to 10 percent by weight of a member selected from the group of 3-vinylbenzyl alcohol, 4-vinylbenzyl alcohol, 3-vinylbenzyl chloride and 4-vinylbenzyl chloride, calculated on the copolymer.

5. Polyamide fiber, characterized in that it is coated with an adhesion promoting amount of a surface treatment agent in accordance with claims 1, 2, 3, or 4.

6. Polymer fiber of claim 5, characterized in that it is made from polyamide which is aromatic.

7. Polymer fiber of claim 5, characterized in that the quantity of coating agent is 0.01 to 5 percent by weight, calculated on fiber weight.

8. Surface treatment agent of one of claims 1 or 2 or 3 or 4 characterized in that the phenoplast is a water soluble product.

9. Surface treatment agent of one of claims 1, 2, 3 and 4 characterized in that the phenoplast in a 65 percent by weight solution shows a viscosity of 0.3 to 1.4 Pas.

* * * * *